US011874041B2

(12) United States Patent
Wang

(10) Patent No.: US 11,874,041 B2
(45) Date of Patent: Jan. 16, 2024

(54) PUMPS, AIR CONDITIONING SYSTEMS, AND METHODS FOR EXTRACTING HEAT

(71) Applicant: Taiwan Happy Energy Co., Ltd., Zhubei (TW)

(72) Inventor: Chih Hung Wang, Zhubei (TW)

(73) Assignee: TAIWAN HAPPY ENERGY CO., LTD., Zhubei (TW)

( * ) Notice: Subject to any disclaimer, the term of this patent is extended or adjusted under 35 U.S.C. 154(b) by 367 days.

(21) Appl. No.: 17/123,259

(22) Filed: Dec. 16, 2020

(65) Prior Publication Data

US 2022/0186990 A1 Jun. 16, 2022

(51) Int. Cl.
*F25B 9/14* (2006.01)

(52) U.S. Cl.
CPC ..... *F25B 9/14* (2013.01)

(58) Field of Classification Search
CPC .. F25B 9/14; F25B 11/02; F25B 30/02; F25B 41/00
See application file for complete search history.

(56) References Cited

U.S. PATENT DOCUMENTS

| | | | |
|---|---|---|---|
| 3,608,311 | A | 9/1971 | Roesel, Jr. |
| 2006/0059912 | A1 | 3/2006 | Romanelli et al. |
| 2012/0055145 | A1 | 3/2012 | Blieske |

FOREIGN PATENT DOCUMENTS

| | | | |
|---|---|---|---|
| JP | S 63162974 | A | 7/1988 |
| JP | H 07507370 | A | 8/1995 |
| JP | 2006-336546 | A | 12/2006 |
| WO | WO 92/19924 | A1 | 11/1992 |

*Primary Examiner* — Nael N Babaa
(74) *Attorney, Agent, or Firm* — Finnegan, Henderson, Farabow, Garrett & Dunner, L.L.P

(57) ABSTRACT

A method for extracting heat includes: during a first period: opening a first passage between a first chamber and a third chamber to compress gas in the third chamber; and opening a second passage between a second chamber and a fourth chamber to decompress gas in the fourth chamber. The method further includes during a second period following the first period: closing the first passage and the second passage; enabling a gas flow into the first chamber, the gas flow comprising gas having a first temperature; and outputting gas having a temperature that is lower than the first temperature of the gas in the second chamber.

16 Claims, 10 Drawing Sheets

PUMPS, AIR CONDITIONING SYSTEMS, AND METHODS FOR EXTRACTING HEAT

TECHNICAL FIELD

The present disclosure relates to devices, methods, and systems for extracting heat, and more particularly, to devices, methods, and systems for extracting heat from air to produce gases having different temperatures.

BACKGROUND

Refrigerants, such as chlorofluorocarbons (CFCs) and hydrochlorofluorocarbons (HCFCs), are commonly used in air conditioning systems. However, conventional refrigerants or their alternatives may result in environmental impacts, such as causing the greenhouse gas emission or adversely affecting the stratospheric ozone layer. In addition, some refrigerants may be flammable or toxic. While liquid-cooling systems have been applied in various applications, such as industrial cooling towers, most of those systems consume significant amount of water. Many systems also require continuously circulating cooling water through heat exchangers to dissipate heat. Water consumption frequently presents constraints for regions where water resource is limited.

Accordingly, as the awareness of sustainability grows, it may be desirable or beneficial to improve air conditioning or cooling systems to provide energy-efficient and/or environment-friendly systems. It may also be desirable to meet increasingly stringent eco-friendliness standards in various sectors.

SUMMARY

The present disclosure provides a pump. Consistent with one of the embodiments, the pump includes a first chamber containing a working fluid and providing a first space, the first space being above at least a portion of the working fluid that is within the first chamber; an input passage coupled to the first chamber and configured to provide gas having a first temperature; a second chamber coupled with the first chamber, the working fluid flowable between the first chamber and the second chamber via at least one first flow passage between the first chamber and the second chamber, the second chamber providing a second space, the second space being above at least a portion of the working fluid that is within the second chamber; a first output passage coupled to the second chamber and configured to output the gas having a second temperature, the second temperature being lower than the first temperature; and a control device coupled to the first chamber and the second chamber via one or more second flow passages, wherein the one or more second flow passages have a controllable gas flow between the first chamber and the control device or between the second chamber and the control device.

Consistent with some other embodiments, the present disclosure further provides a method for extracting heat. The method includes during a first period: opening a first passage between a first chamber and a third chamber to compress gas in the third chamber; and opening a second passage between a second chamber and a fourth chamber to decompress gas in the fourth chamber. The method also includes during a second period following the first period: closing the first passage and the second passage; enabling a gas flow into the first chamber, the gas flow including gas having a first temperature; and outputting gas having a temperature that is lower than the first temperature of the gas in the second chamber.

Consistent with further embodiments, the present disclosure further provides an air conditioning system. The air conditioning system includes a first chamber and a second chamber coupled with each other, a working fluid being flowable between the first chamber and the second chamber via at least one first flow passage between the first chamber and the second chamber; a control device coupled to the first chamber and the second chamber via one or more second flow passages having a controllable gas flow between the first chamber and the control device or between the second chamber and the control device; an input passage configured to provide gas having a first temperature; and a first output passage configured to output gas having a second temperature, the second temperature being lower than the first temperature.

It is to be understood that the foregoing general descriptions and the following detailed descriptions are exemplary and explanatory only, and are not restrictive of the disclosure, as claimed.

BRIEF DESCRIPTION OF THE DRAWINGS

The accompanying drawings, which are incorporated in and constitute a part of this specification, illustrate several embodiments and, together with the description, serve to explain the disclosed principles. In the drawings.

DETAILED DESCRIPTION

Reference will now be made in detail to exemplary embodiments, examples of which are illustrated in the accompanying drawings and disclosed herein. Wherever convenient, the same reference numbers will be used throughout the drawings to refer to the same or like parts. The implementations set forth in the following description of exemplary embodiments are examples of devices and methods consistent with the aspects related to the disclosure as recited in the appended claims, and not meant to limit the scope of the present disclosure.

Figure 1:
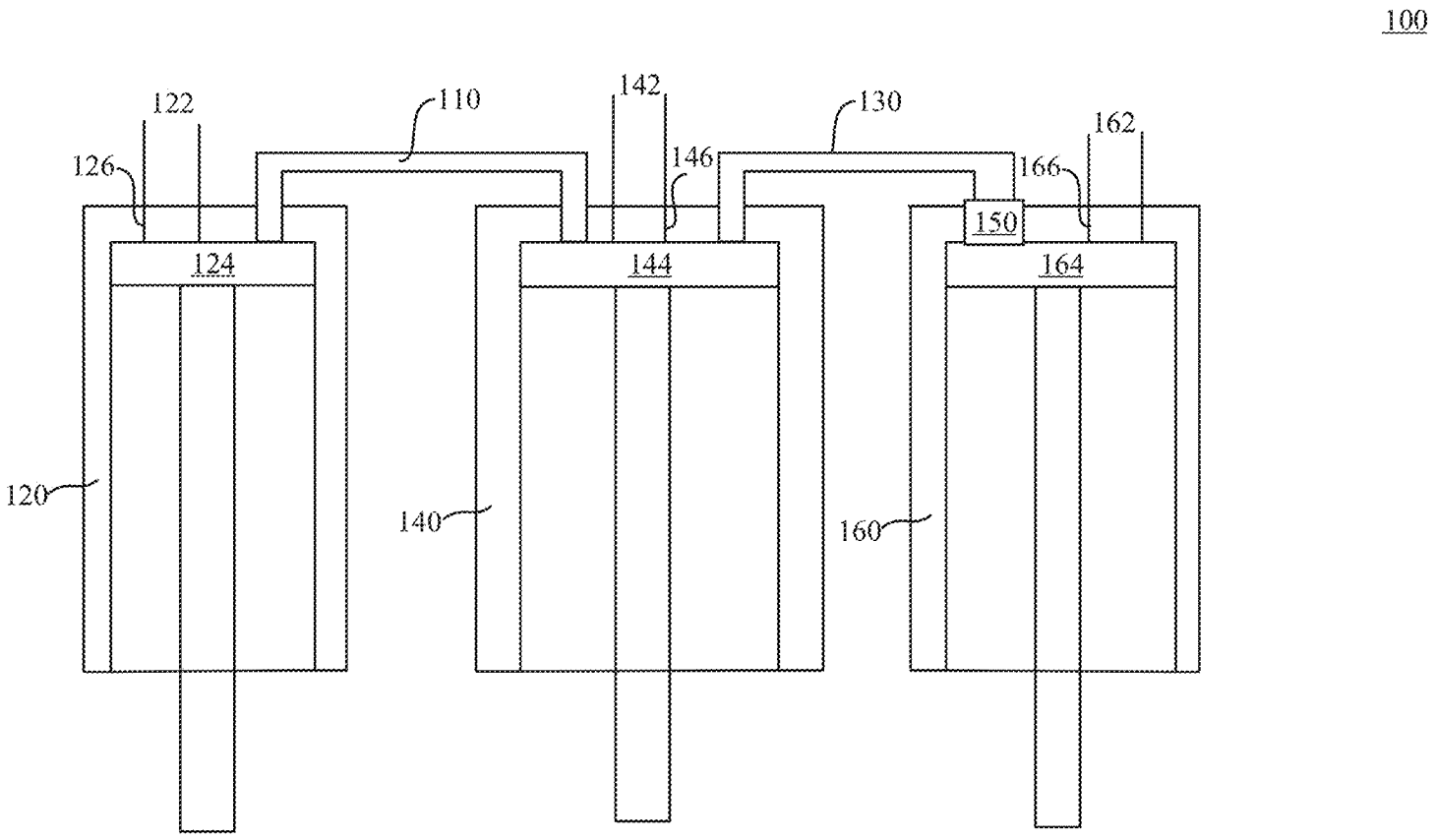
FIG. 1 illustrates an exemplary pump for producing gases having different temperatures, consistent with some embodiments of the present disclosure.

FIG. 1 is an exemplary diagram for illustrating an exemplary pump 100 for producing gases having different temperatures, consistent with some embodiments of the present disclosure. Pump 100 may operate without conventional refrigerants in some embodiments. As shown in FIG. 1, pump 100 includes chambers 120, 140 and 160 respectively having pistons 124, 144, and 164. At an initializing period in FIG. 1, pistons 124, 144, and 164 may be placed at their Top Dead Center (TDC) positions. An input passage 122 is coupled to chamber 120 and is configured to provide input gas (e.g., gas having a first temperature) into chamber 120. An output passage 142 is coupled to chamber 140 and is configured to output high-temperature output gas (e.g., gas having a temperature higher than the first temperature) from chamber 140. An output passage 162 is coupled to chamber 160 and is configured to output low-temperature output gas (e.g., gas having a temperature lower than the first temperature) from chamber 160. Control valves 126, 146, and 166 may respectively configured to open or close independently, either partially or fully, to respectively control the gas flow between chambers 120, 140, and 160 and input/output passages 122, 142, and 162.

Chambers 120 and 140 are coupled with each other via a flow passage 110. Chambers 140 and 160 are coupled with each other via a flow passage 130. In some embodiments, the gas may flow between chambers 120 and 140 via flow passage 110. On the other hand, a control valve 150 is arranged at an end of flow passage 130 and configured to open or close, partially or fully, to control the gas flow between chambers 140 and 160.

Figure 2A:
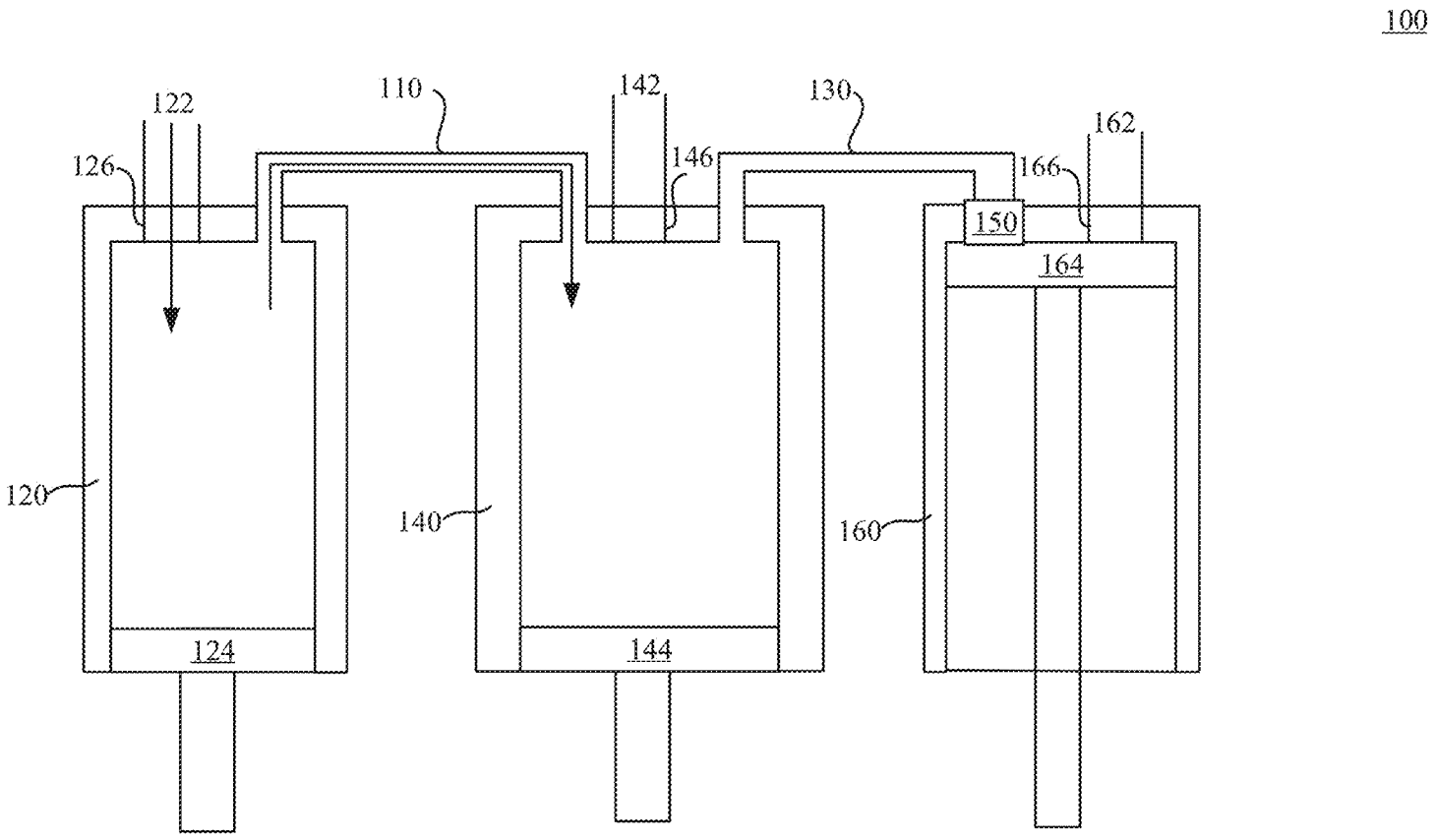
FIGS. 2A-2C are exemplary diagrams illustrating operations of the pump shown in FIG. 1, consistent with some embodiments of the present disclosure.
Figure 2B:
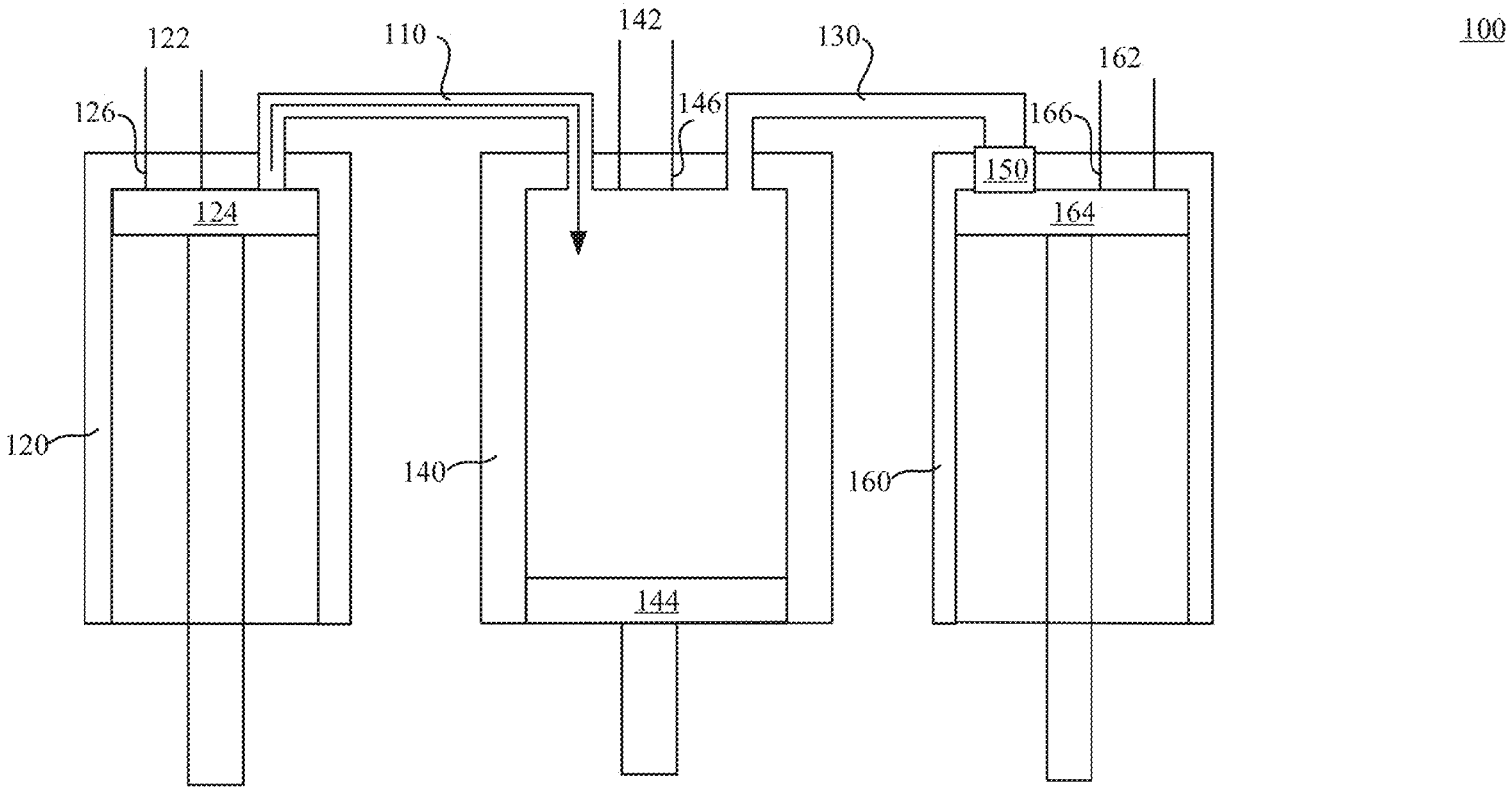
Figure 2C:
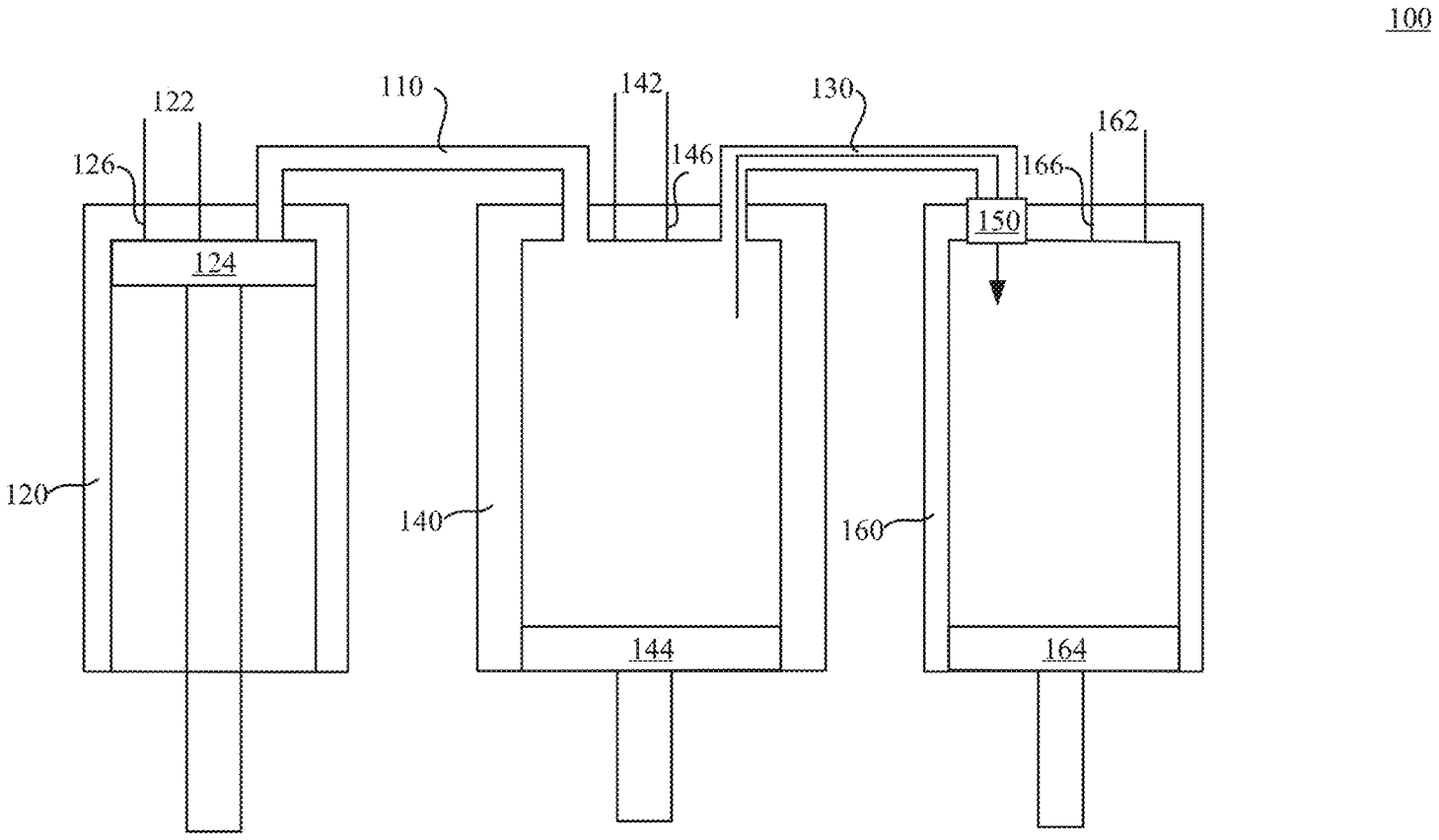

FIGS. 2A-2C are exemplary diagrams illustrating operations of pump 100 shown in FIG. 1, consistent with some embodiments of the present disclosure. During a first period, control valve 126 may be opened, while control valves 146, 150, and 166 may be closed to block the gas flow. Pistons 124 and 144 are configured to respectively move to their Bottom Dead Center (BDC) positions. Accordingly, the gas with an initial temperature (e.g., temperature T0, such as room temperature of 300K) flows into chamber 120 via input passage 122, and then flows into chamber 140 via passage 110 as well. FIG. 2A illustrates pump 100 when pistons 124 and 144 are positioned at their Bottom Dead Center (BDC) positions.

Then, during a second period, control valves 126, 146, 150, and 166 may be closed to block the gas flow. Piston 124 is configured to move back to its TDC position. During this process, the movement of piston 124 causes an adiabatic compression of the gas in chambers 120 and 140, and the pressure and the temperature of the gas in chamber 140 both rise accordingly. For example, the gas in chamber 140 may be at a temperature (e.g., temperature T1, such as temperature around 390K-520K depending on the compression ratio) higher than the initial temperature. FIG. 2B illustrates pump 100 when piston 124 is positioned back at its TDC position.

Next, during a third period, control valve 150 may be opened while control valves 126, 146, and 166 may be closed to block the gas flow. Piston 164 is configured to move to its BDC position. During this process, the movement of piston 164 causes the gas in chamber 140 flows into chamber 160, which is an adiabatic expansion process and causes a drop in the temperature. FIG. 2C illustrates pump 100 when piston 164 is positioned at its BDC position. Particularly, as the pressure on the adiabatically isolated system decreases and the volume increases, the temperature falls as the internal energy decreases.

Next, during a fourth period, control valves 126 and 150 may be closed, while control valves 146 and 166 may be opened. Pistons 144 and 164 are both configured to move back to their TDC positions, causing pump 100 separately outputting the gas in chamber 140 and the gas in chamber 160 via output passages 142 and 162. When pistons 144 and 164 are positioned back at their TDC positions, a cycle is completed and pump 100 may return to the initializing period shown in FIG. 1.

Assuming that the heat loss is nominal or can be ignored and the volume of chambers 120, 140 and 160 are the same, after the adiabatic compression and expansion in the second and the third periods, the average temperature of the gas in chambers 140 and 160 should be equal to the temperature of the inputted gas (e.g., temperature T0). However, temperatures of the gas in chamber 140 and of the gas in chamber 160 would be different. Particularly, during the adiabatic expansion, the work done by the gas results in the temperature drop. When the gas expands by dV, the work done by the gas in the expansion can be denoted as $dW=(P1-P2)dV$, in which P1 denotes the pressure in chamber 140 and P2 denotes the pressure in chamber 160, while the total work done by the gas in the expansion should be $dW=(P1)dV$ to follow an adiabatic expansion to have the temperature of the gas in chamber 140 be back to the initial temperature.

Accordingly, in reality, the temperature of the gas in chamber 140 would be slightly lower than the temperature of the compressed gas (e.g., temperature T1) in the second period, but much higher than the initial temperature (e.g., temperature T0). Because the average temperature of chambers 140 and 160 would equal to the initial temperature, the gas in chamber 160 would be at a temperature (e.g., temperature T2) lower than the initial temperature. In addition, because during the expansion process, the pressure of chamber 140 is greater than the pressure of chamber 160, some gas moves from chamber 140 to chamber 160 via flow passage 130. Thus, the gas with the relatively low temperature does not flow back from chamber 160 to chamber 140.

By the adiabatic compression and expansion in the second and the third periods, the gas is divided into the gas having a relatively high temperature within chamber 140 and the gas having a relatively low temperature within chamber 160. Accordingly, when pistons 144 and 164 move from BDC positions to TDC positions, pump 100 outputs the high temperature gas in chamber 140 via output passage 142, and outputs the low temperature gas in chamber 160 via output passage 162.

Figure 3:
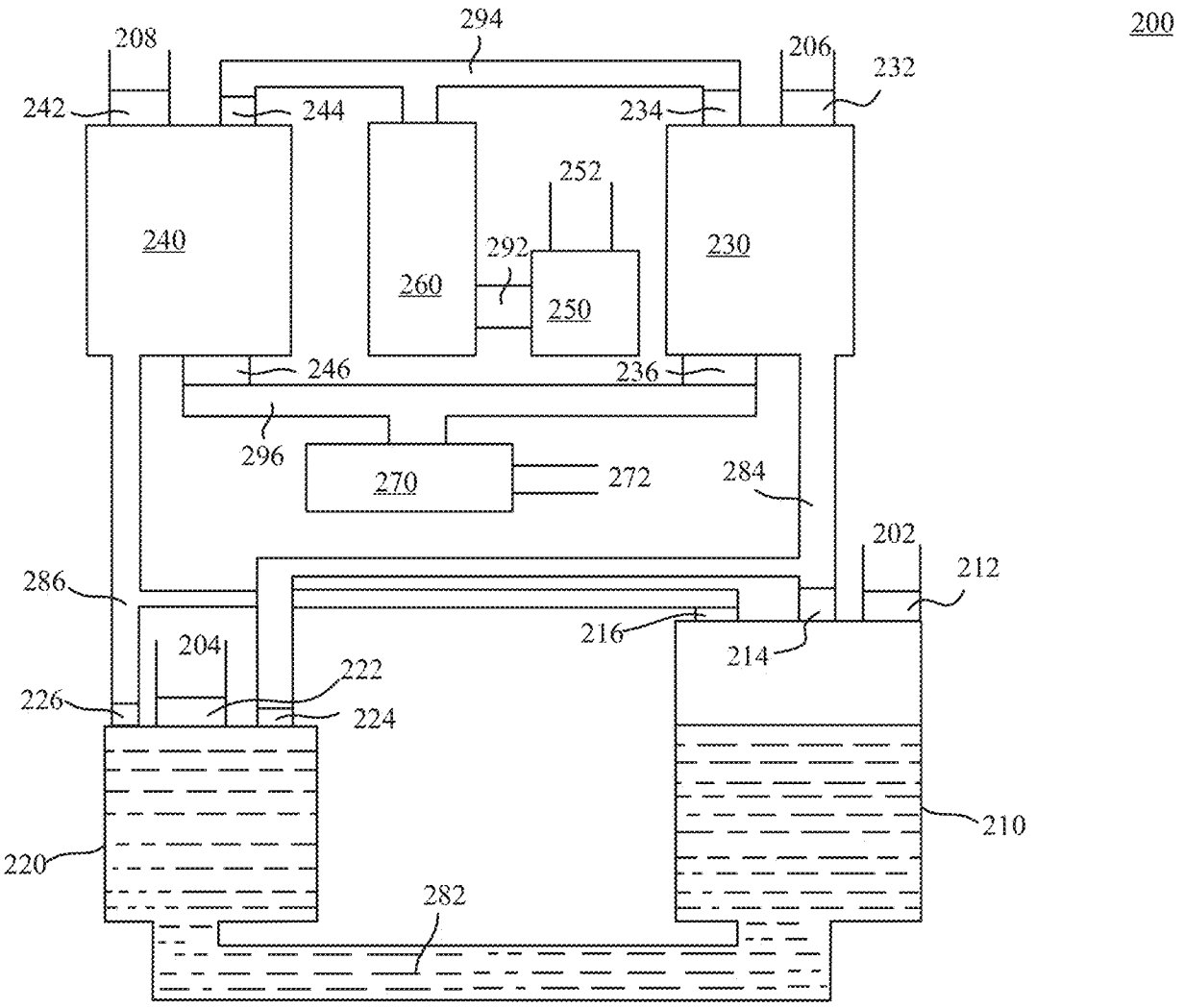
FIG. 3 is an exemplary diagram illustrating a pump with a liquid piston for producing gases having different temperatures, consistent with some embodiments of the present disclosure.

In some embodiments, liquid pistons can be used to provide a greater adiabatic efficiency. FIG. 3 is an exemplary diagram illustrating a pump 200 with a liquid piston for producing gases having different temperatures, consistent with some embodiments of the present disclosure. As shown in FIG. 3, pump 200 includes chambers 210, 220, 230, and 240. Chamber 210, which works as a gas compressor, contains a working fluid and provides a space above at least a portion of the working fluid that is within chamber 210. Chamber 220, which works as a gas expander, is coupled (e.g., fluidly coupled) with chamber 210. That is, the working fluid is flowable between chambers 210 and 220 via at least one flow passage 282 between chambers 210 and 220. In some embodiments, chambers 210 and 220 and flow passage 282 can further be integrated as a single U-shaped tube.

Chamber 220 also provides a space above at least a portion of the working fluid that is within chamber 220. Chambers 230 and 240 collectively form a control device for the adiabatic compression and expansion process, which will be discussed in detail in the following paragraphs. Particularly, chambers 230 and 240 are both coupled to chambers 210 and 220 via flow passages 284 and 286.

By the operations of control valves 214, 216, 224, and 226, flow passages 284 and 286 may be selectively opened or closed to control the gas flow between chamber 210 and the control device (e.g., chambers 230 and 240), or between chamber 220 and the control device (e.g., chambers 230 and 240). Alternatively stated, flow passages 284 and 286 have controllable gas flows between the chamber 210 and the control device or between the chamber 220 and the control device.

Input passage 202 is coupled to chamber 210 via a control valve 212 and is configured to provide the input gas having a first temperature into the space in chamber 210. Output passage 204 is coupled to chamber 220 via a control valve 222 and is configured to output the gas having a second temperature lower than the first temperature from the space in chamber 220.

Output passages 206 and 208 are separately coupled to chambers 230 and 240, via control valves 232 and 242 and are configured to output the gas having a third temperature higher than the first temperature from chambers 230 and 240.

As shown in FIG. 3, in some embodiments, in addition to chambers 230 and 240, the control device may further include an air compressor 250, a gas container 260, an air blower 270. Air compressor 250 is configured to compress the input air from an input passage 252 and store the compressed gas into gas container 260 via a passage 292 coupled to air compressor 250 and gas container 260. The compressed gas stored in gas container 260 can be transmitted into chambers 230 and 240 via a passage 294 and control valves 234 and 244. Accordingly, control valves 234 and 244 arranged at two ends of passage 294 coupling chambers 230 and 240 are configured to respectively control whether the gas is flowable from gas container 260 to chambers 230 and 240 in order to adjust the air pressure within chambers 230 and 240 and facilitate the operations of pump 200.

Air blower 270 is coupled to chambers 230 and 240 and configured to enable a gas flow into chambers 230 or 240 via a passage 296. In some embodiments, the gas flow includes a gas having a temperature lower than a current temperature of the gas in chamber 230 or 240. Control valves 236 and 246 arranged at two ends of passage 296 coupling chambers 230 and 240 are configured to respectively control whether the gas is flowable from air blower 270 to chambers 230 and 240, in order to adjust the temperature within chambers 230 and 240 and facilitate the operations of pump 200.

FIGS. 4A-4D are exemplary diagrams illustrating operations of pump 200 shown in FIG. 3, consistent with some embodiments of the present disclosure. During the initial stage, the air pressure of chamber 240 is greater than or equal to an operating pressure value (e.g., having a pressure value P2). If the air pressure of chamber 240 is less than the operating pressure value, control valve 244 is opened to enable the compressed gas stored in gas container 260 to flow into chamber 240 to increase the air pressure within chamber 240. On the other hand, the air pressure (e.g., an initial pressure value P0) of the spaces within chambers 210 and 220 above the working fluid is equal to the air pressure at input passage 202. In some embodiments, the air pressure within chamber 230 may be equal to the initial pressure value P0.

Figure 4A:
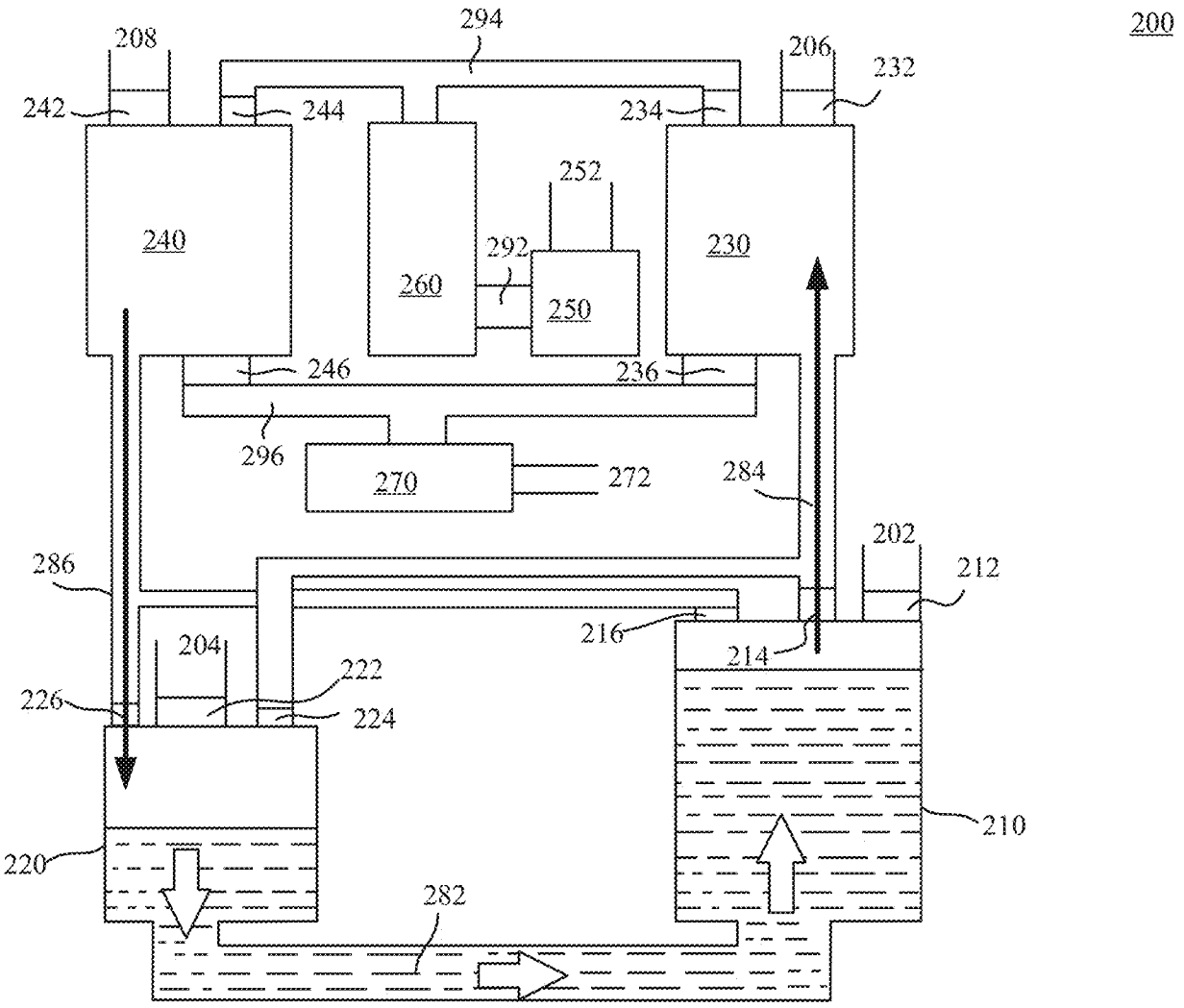
FIGS. 4A-4D are exemplary diagrams illustrating operations of the pump shown in FIG. 3, consistent with some embodiments of the present disclosure.

Then, as shown in FIG. 4A, during a first period, control valves 214 and 226 are opened, while other control valves are closed to block the gas flow. Because the air pressure of chamber 240 is greater than the air pressure of the spaces within chambers 210 and 220, the gas in chamber 240 expands and flows to chamber 220.

That is, when control valve 226 is opened to connect chamber 220 and chamber 240, as the pressure in chamber 220 becoming greater than the pressure in chamber 210, a portion of the working fluid in chamber 220 flows to chamber 210 via flow passage 282. Accordingly, the surface of working liquid within chamber 210 rises as the surface of working liquid within chamber 220 falls. As a result, a portion of the gas in the space of chamber 210 flows into chamber 230 via flow passage 284 to compress the gas in chamber 230, and the air pressure within chamber 230 increases to a pressure value P1, which is greater than the initial pressure value P0.

Figure 4B:
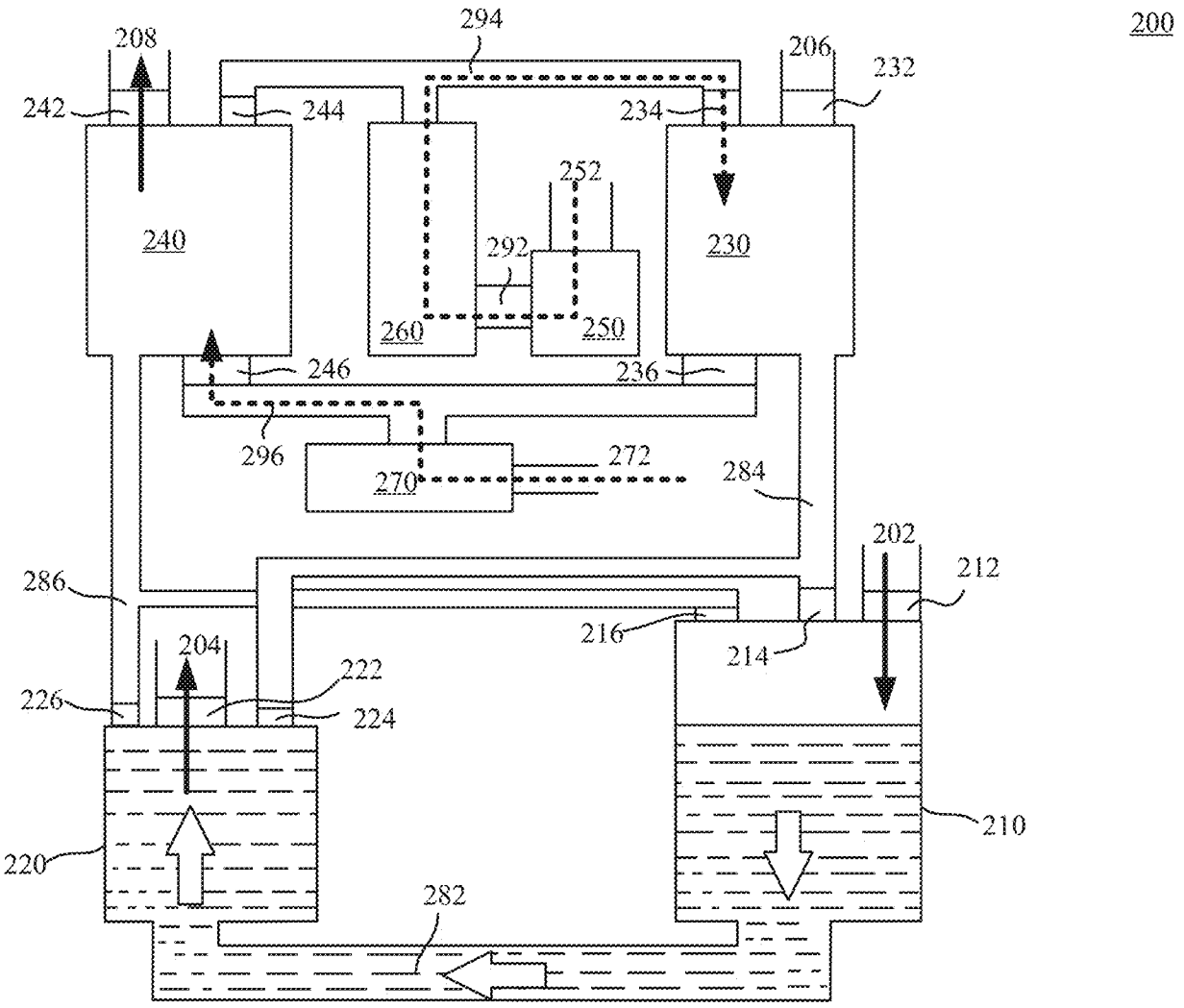

Then, as shown in FIG. 4B, during a second period, control valves 212 and 222 are opened and the air pressure of chambers 210 and 220 is again balanced with the external pressure (e.g., initial pressure value P0). Accordingly, the surface of working liquid within chamber 210 falls as the surface of working liquid within chamber 220 rises to reach the same level due to the gravity. Particularly, the gas having the initial temperature (e.g., initial temperature T0) is inputted into chamber 210 via input passage 202. A portion of the working fluid in chamber 210 flows to chamber 220 to output a portion of the gas from the space of chamber 220 via output passage 204. The gas outputted from the space of chamber 220 has a temperature (e.g., temperature T1) lower than initial temperature T0 due to the gas expansion within chambers 220 and 240 during the first period. As discussed in the embodiments of FIG. 1 and FIGS. 2A-2C, after the gas expansion, the temperature of the gas within chamber 240 (e.g., temperature T2) will be greater than the initial temperature T0, and the temperature of the gas within chamber 220 (e.g., temperature T1) will be lower than the initial temperature T0.

In addition, control valves 242 and 246 are also opened so that air blower 270 can provide the gas having a temperature (e.g., the initial temperature T0) lower than the current temperature T2 of chamber 240 via passage 296 and control valve 246 into chamber 240. Accordingly, a portion of the gas having the higher temperature (e.g., temperature T2) will be outputted via control valve 242 and output passage 208. Alternatively stated, in the second period, output passage 208 is configured to output a portion of the gas having a temperature higher than the initial temperature T0 from chamber 240 of the control device.

In order to facilitate the following operations, in some embodiments, control valve 234 can also be opened in the second period. By such operations, a portion of the gas compressed by air compressor 250 and stored in gas container 260 can flow into chamber 230 via passage 294 and control valve 234 to increase the air pressure within chamber 230, to ensure that the air pressure within chamber 230 is equal to or greater than the operating pressure value (e.g., pressure value P2).

Figure 4C:
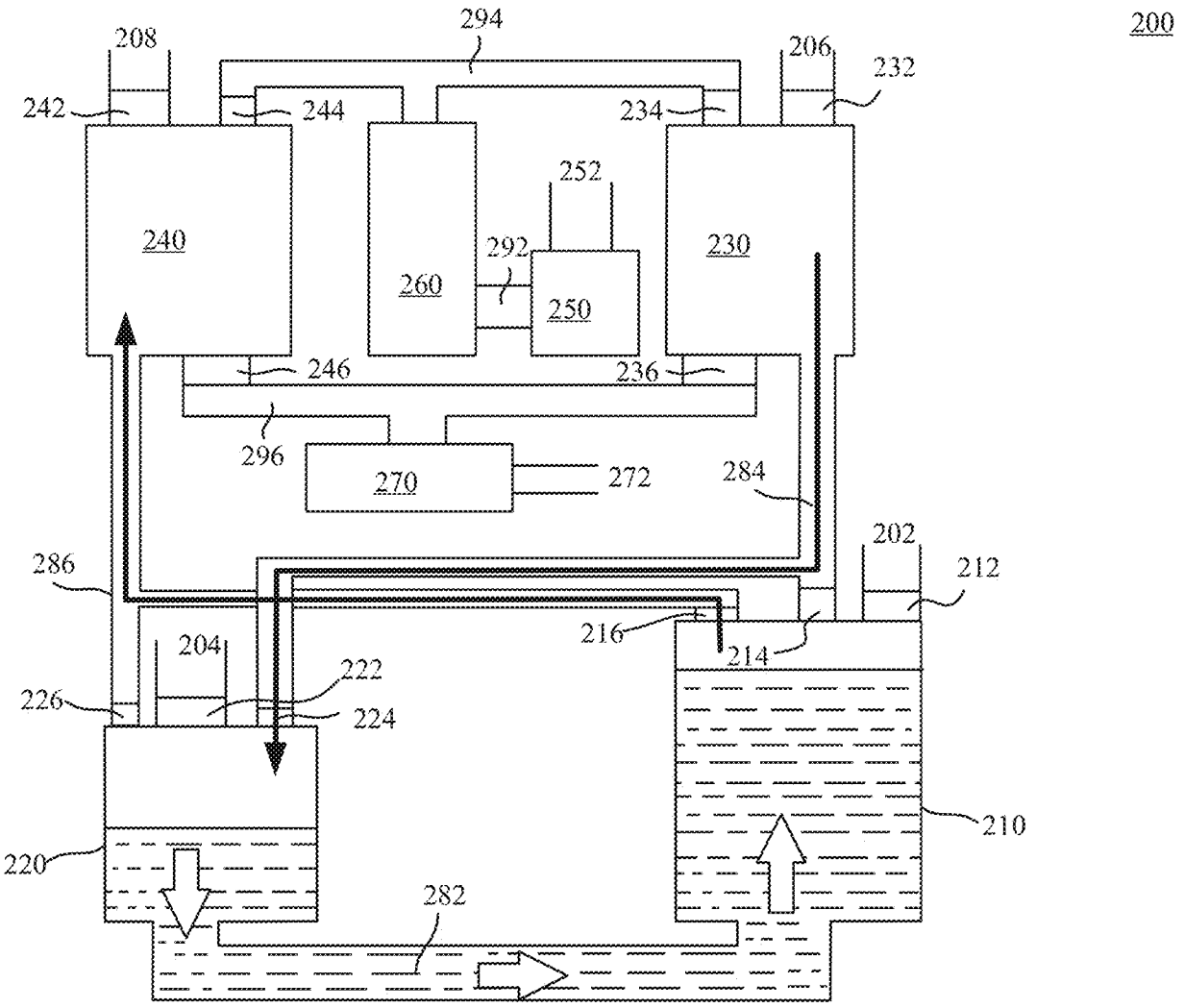

During a third period following the second period, as shown in FIG. 4C, control valves 216 and 224 are opened, while other control valves are closed to block the gas flow. Because the air pressure of chamber 230 is now greater than the air pressure of the spaces within chambers 210 and 220, the gas in chamber 230 expands and a portion of the gas flows to chamber 220.

That is, when control valve 224 is opened to connect chamber 220 and chamber 230, similar to the first period, the pressure in chamber 220 again becomes greater than the pressure in chamber 210, and thus a portion of the working fluid in chamber 220 flows to chamber 210 via flow passage 282. Again, the surface of working liquid within chamber 210 rises as the surface of working liquid within chamber 220 falls. As a result, a portion of the gas in the space of chamber 210 now flows into chamber 240 via flow passage 286 to compress the gas in chamber 240, and the air pressure within chamber 240 increases to the pressure value P1, which is greater than the initial pressure value P0.

Figure 4D:
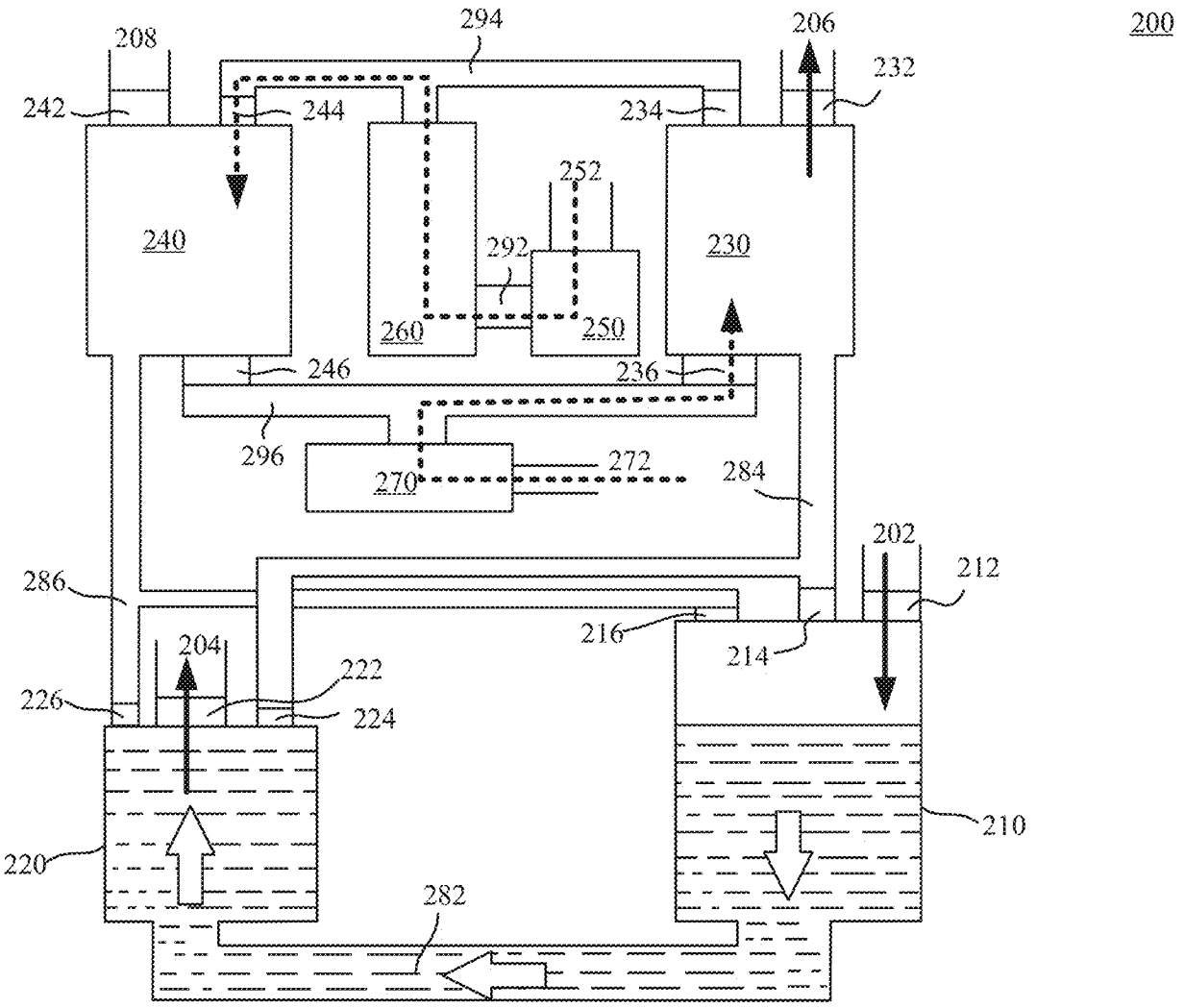

Then, as shown in FIG. 4D, during a fourth period, similar to the second period, control valves 212 and 222 are opened, and the air pressure of chambers 210 and 220 is again balanced with the external pressure (e.g., initial pressure value P0). Again, the surface of working liquid within chamber 210 falls as the surface of working liquid within chamber 220 rises to reach the same level due to the gravity. Particularly, the gas having the initial temperature (e.g., initial temperature T0) is inputted into chamber 210 via input passage 202. A portion of the working fluid in chamber 210 flows to chamber 220 to output a portion of the gas from the space of chamber 220 via output passage 204. The gas outputted from the space of chamber 220 has the temperature (e.g., temperature T1) lower than the initial temperature T0 due to the gas expansion within chambers 220 and 230 during the third period. As discussed above, after the gas expansion in the third period, the temperature of the gas within chamber 230 (e.g., temperature T2) will be greater than the initial temperature T0, and the temperature of the gas within chamber 220 (e.g., temperature T1) will be lower than the initial temperature T0.

In addition, control valves 232 and 236 are also opened so that air blower 270 can now provide a portion of the gas having the temperature (e.g., the initial temperature T0) lower than the current temperature T2 of chamber 230 via passage 296 and control valve 236 into chamber 230. Accordingly, a portion of the gas having the higher temperature (e.g., temperature T2) will now be outputted via control valve 232 and output passage 206. Alternatively stated, in the fourth period, output passage 206 is configured to output the gas having the temperature T2 higher than the temperature T0 from chamber 230 of the control device. By such operations, the control device having two chambers 230 and 240 can output the high-temperature gas via different output passages 208 and 206 in the second period and in the fourth period.

Similarly, to ensure that the air pressure within chamber 240 is equal to or greater than the operating pressure value (e.g., pressure value P2) for the first period in the next cycle, in some embodiments, control valve 244 can be opened in the fourth period so that a portion of the gas compressed by air compressor 250 and stored in gas container 260 can flow into chamber 240 via passage 294 and control valve 244 to increase the air pressure within chamber 240.

The operations shown in FIGS. 4A-4D form a complete cycle, in which gas compression and expansion are performed in the first and the third periods to separate high-temperature gas and low-temperature gas. Particularly, the low-temperature gas can be stored within chamber 220 and the high-temperature gas can be stored within chamber 230 or chamber 240. Then, in the second and the fourth periods respectively following the first and the third periods, the gas with the initial temperature is fed into chamber 210, while a portion of the low-temperature gas is outputted from chamber 220 and a portion of the high-temperature gas is outputted from chamber 240 or chamber 230.

The outputted high-temperature gas and low-temperature gas can be used in various applications. For example, an air conditioning system can include pump 200 to provide low-temperature air as the refrigerant. Compared to air conditioning systems using conventional refrigerants, which may be flammable or toxic and result in harmful environmental effects, air conditioning systems applying pump 200 can achieve simultaneous heating and cooling for residential or automobiles, with lower environmental impact than conventional heating and refrigeration devices. For example, air conditioning systems using low-temperature air as the refrigerant can reduce the greenhouse gas emission or the destruction of the stratospheric ozone layer contributed by conventional refrigerants. Moreover, liquid-cooling systems generally require a large amount of water resource. Air conditioning systems applying pump 200 provide gas cooling with improved efficiency, and thus are suitable to provide cooling where water resource is limited.

In addition, compared to other systems using air as the refrigerant, embodiments of the present disclosure provide a practical solution in various applications with an improved coefficient of performance (COP) and energy efficiency, and thus achieve the heating and cooling with lower energy consumption.

In some other embodiments, alternative devices or methods may be applied to replace air blower 270 and configured to exchange the high-temperature gas within chambers 230 and 240. For example, in some other embodiments, the control device may include one or more pistons (e.g., liquid pistons) arranged in chamber 230 and chamber 240 to exchange the gas within chamber 230 and chamber 240, so the heat energy stored in the high-temperature gas can be kept and reused in other energy forms. For example, a waste-heat-to-power system can be deployed to convert the heat into electricity.

In some other embodiments, the control device may include one or more spray devices coupled to chamber 230 or chamber 240. The spray device(s) can be configured to cool the gas in chamber 230 or chamber 240 by spraying liquid.

Figure 5:
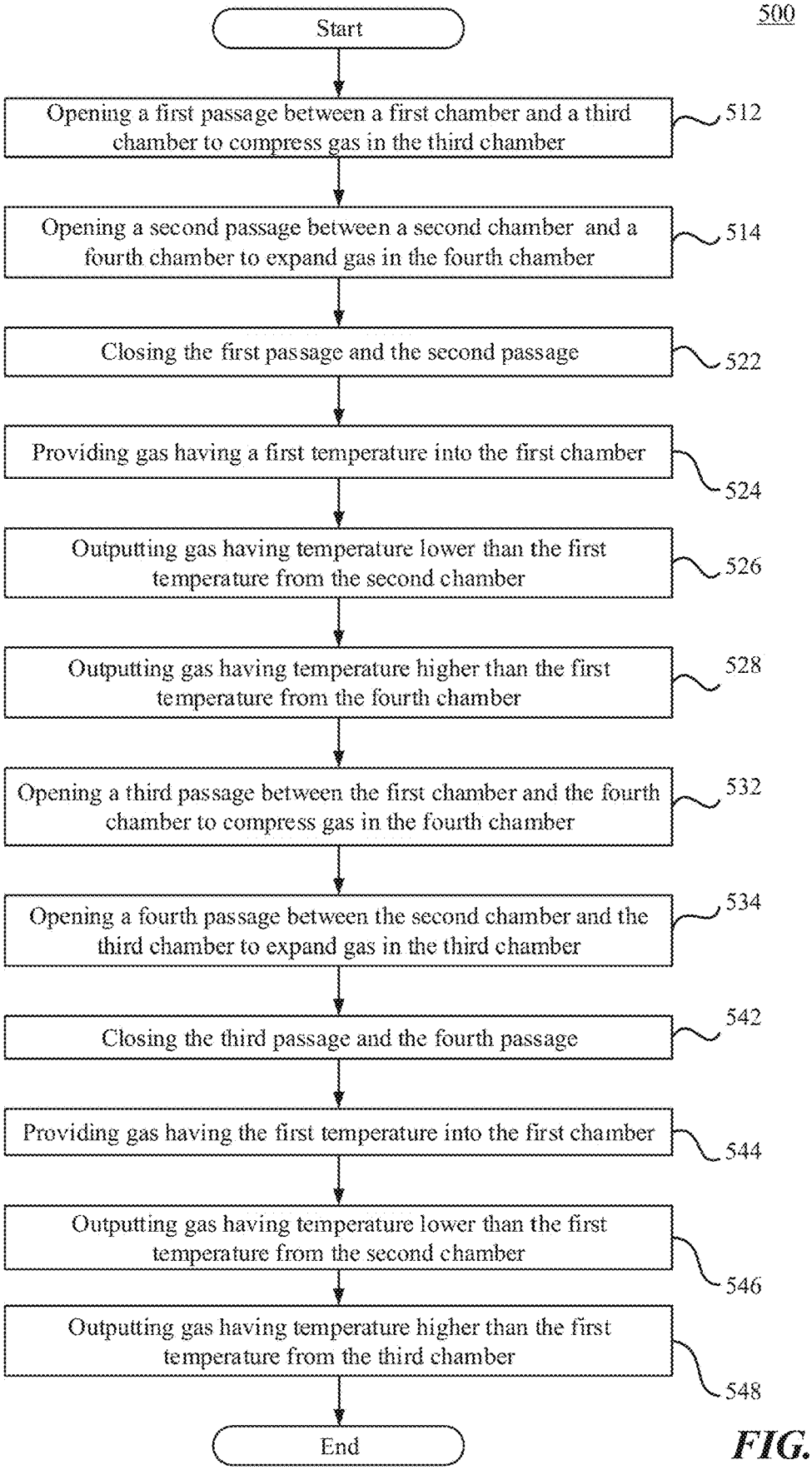
FIG. 5 illustrates an exemplary flow chart for performing a method for extracting heat, consistent with some embodiments of the present disclosure.

FIG. 5 illustrates an exemplary flow chart for performing a method 500 for extracting heat, consistent with some embodiments of the present disclosure. Method 500 can be performed in air conditioning systems by a pump (e.g., pump 100 in FIG. 1 or pump 200 in FIG. 3) according to some embodiments of the present disclosure.

At step 512, during a first period (e.g., the period shown in FIG. 4A), the pump opens a first passage (e.g., the arrow denoted in passage 284 in FIG. 4A) between a first chamber (e.g., chamber 210) and a third chamber (e.g., chamber 230) to compress gas in the third chamber. At step 514, during the first period, the pump opens a second passage (e.g., the arrow denoted in passage 286 in FIG. 4A) between a second chamber (e.g., chamber 220) and a fourth chamber (e.g., chamber 240) to decompress gas in the fourth chamber.

At step 522, during a second period (e.g., the period shown in FIG. 4B) following the first period, the pump closes the first passage and the second passage. At step 524, during the second period, the pump enables a gas flow into the first chamber, in which the gas flow includes the gas having a first temperature (e.g., room temperature). At step 526, during the second period, the pump outputs a portion of the gas having a temperature that is lower than the first temperature of the gas in the second chamber. Particularly, a portion of the gas in the space of the second chamber exits via an output passage coupled to the second chamber. At step 528, during the second period, the pump outputs a portion of the gas having temperature higher than the first temperature from the fourth chamber. Particularly, the control device is configured to enable a gas flow via another output passage coupled to the fourth chamber, so that a portion of the gas in the space of the fourth chamber exits via the output passage coupled to the fourth chamber. Particularly, in some embodiments, the pump can provide a portion of the gas having a temperature lower than a current temperature of the fourth chamber into the fourth chamber by an air blower (e.g., air blower 270 in FIG. 4B). In some embodiments, cooling liquid can be sprayed by one or more spray devices into the fourth chamber to cool the gas in the fourth chamber during the second period.

At step 532, during a third period (e.g., the period shown in FIG. 4C) following the second period, the pump opens a third passage (e.g., the arrow denoted in passage 286 in FIG. 4C) between the first chamber and the fourth chamber to compress gas in the fourth chamber. At step 534, during the third period, the pump opens a fourth passage (e.g., the arrow denoted in passage 284 in FIG. 4C) between the second chamber and the third chamber to expand gas in the third chamber.

At step 542, during a fourth period (e.g., the period shown in FIG. 4D) following the third period, the pump closes the third passage and the fourth passage. At step 544, during the fourth period, the pump provides gas having the first temperature (e.g., room temperature) to the first chamber. At step 546, during the fourth period, the pump outputs a portion of the gas having temperature lower than the first temperature from the second chamber. Particularly, a portion of the gas in the space of the second chamber exits via the output passage coupled to the second chamber. At step 548, during the fourth period, the pump outputs a portion of the gas having temperature higher than the first temperature from the third chamber. Particularly, the control device is configured to enable a gas flow via another output passage coupled to the third chamber, so that a portion of the gas in the space of the third chamber exits via the output passage coupled to the third chamber. Similarly, in some embodiments, the pump can provide a portion of the gas having a temperature lower than a current temperature of the third chamber into the third chamber by the air blower. In some embodiments, cooling liquid can be sprayed by one or more spray devices into the third chamber to cool the gas in the third chamber during the fourth period.

In some embodiments, the pump can repeat steps 512-548 continuously to generate high temperature and low temperature gases for air conditioning systems to heat or cool buildings or automobiles.

By performing method 500 described above, the pump can extract the heat from the inputted air to produce and output both high-temperature and low-temperature gases for various applications. In view of the above, as proposed in various embodiments of the present disclosure, the proposed devices and methods can improve the coefficient of performance and energy efficiency of air-cooling or conditioning systems.

In the foregoing specification, embodiments have been described with reference to numerous specific details that can vary from implementation to implementation. Certain adaptations and modifications of the described embodiments can be made. It is also intended that the sequence of steps shown in figures are only for illustrative purposes and are not intended to be limited to any particular sequence of steps. As such, those skilled in the art can appreciate that these steps can be performed in a different order while implementing the same method.

As used herein, unless specifically stated otherwise, the term "or" encompasses all possible combinations, except where infeasible. For example, if it is stated that a database may include A or B, then, unless specifically stated otherwise or infeasible, the database may include A, or B, or A and B. As a second example, if it is stated that a database may include A, B, or C, then, unless specifically stated otherwise or infeasible, the database may include A, or B, or C, or A and B, or A and C, or B and C, or A and B and C.

In the drawings and specification, there have been disclosed exemplary embodiments. It will be apparent to those skilled in the art that various modifications and variations can be made to the disclosed system and related methods. Other embodiments will be apparent to those skilled in the art from consideration of the specification and practice of the disclosed system and related methods. It is intended that the specification and examples be considered as exemplary only, with a true scope being indicated by the following claims and their equivalents.

What is claimed is:

1. A pump, comprising:

a first chamber containing a working fluid and providing a first space, the first space being above at least a portion of the working fluid that is within the first chamber;

an input passage coupled to the first chamber and configured to provide gas having a first temperature;

a second chamber coupled with the first chamber, the working fluid flowable between the first chamber and the second chamber via at least one first flow passage between the first chamber and the second chamber, the second chamber providing a second space, the second space being above at least a portion of the working fluid that is within the second chamber;

a first output passage coupled to the second chamber and configured to output the gas having a second temperature, the second temperature being lower than the first temperature; and a control device coupled to the first chamber and the second chamber via one or more second flow passages, wherein the one or more second flow passages have a controllable gas flow between the first chamber and the control device or between the second chamber and the control device;

one or more second output passages coupled to the control device and configured to output a gas having a third temperature, the third temperature being higher than the first temperature;

wherein the control device comprises:

a third chamber and a fourth chamber, wherein in a first period, the gas in the fourth chamber expands and flows to the second chamber, a portion of the working fluid in the second chamber flows to the first chamber, and a portion of the gas in the first space flows to the third chamber to compress the gas in the third chamber.

2. The pump of claim 1, wherein when a gas at the first temperature enters the first space via the input passage, a portion of the working fluid in the first chamber flows into the second chamber and a portion of a gas in the second space exits via the first output passage.

3. The pump of claim 1, wherein in a second period, a portion of the working fluid in the first chamber flows to the second chamber and a portion of the gas in the second space exits via the first output passage.

4. The pump of claim 3, wherein in the second period, the control device is configured to enable a gas flow via the one or more second output passages.

5. The pump of claim 3, wherein in a third period, a portion of the gas in the third chamber expands and flows to the second chamber, a portion of the working fluid in the second chamber flows to the first chamber, and a portion of the gas in the first space flows to the fourth chamber to compress the gas in the fourth chamber.

6. The pump of claim 1, wherein the control device further comprises:

an air blower coupled to the third chamber and the fourth chamber, the air blower being configured to enable a gas flow into the third chamber or the fourth chamber, the gas flow comprising a gas having a temperature lower than a current temperature of the gas in the third chamber or the fourth chamber.

7. The pump of claim 1, wherein the control device further comprises:

one or more spray devices coupled to the third chamber or the fourth chamber and configured to cool the gas in the third chamber or the fourth chamber by spraying liquid.

8. A method for extracting heat, comprising:

during a first period:

opening a first passage between a first chamber and a third chamber to compress gas in the third chamber; and opening a second passage between a second chamber and a fourth chamber to decompress gas in the fourth chamber; and during a second period following the first period:

closing the first passage and the second passage;

enabling a gas flow into the first chamber, the gas flow comprising gas having a first temperature; and outputting gas having a temperature that is lower than the first temperature of the gas in the second chamber.

9. The method of claim 8, further comprising:

during the second period, outputting gas having a temperature that is higher than the first temperature of the gas in the fourth chamber.

10. The method of claim 8, further comprising:

during a third period following the second period:

opening a third passage between the first chamber and the fourth chamber to compress gas in the fourth chamber; and opening a fourth passage between the second chamber and the third chamber to decompress gas in the third chamber.

11. The method of claim 10, further comprising:

during a fourth period following the third period:

closing the third passage and the fourth passage;

enabling a gas flow into the first chamber, the gas flow comprising gas having the first temperature; and outputting gas having a temperature that is lower than the first temperature of the gas in the second chamber.

12. The method of claim 11, further comprising:

during the fourth period, outputting gas having a temperature that is higher than the first temperature of the gas in the third chamber.

13. The method of claim 8, further comprising:

during the second period, enabling, by an air blower, a gas flow into the fourth chamber, the gas flow comprising gas having a temperature that is lower than a current temperature of the gas in the fourth chamber.

14. The method of claim 8, further comprising:

during the second period, spraying, by one or more spray devices, liquid into the fourth chamber to cool the gas in the fourth chamber.

15. An air conditioning system, comprising:

a first chamber and a second chamber coupled with each other, a working fluid being flowable between the first chamber and the second chamber via at least one first flow passage between the first chamber and the second chamber;

a control device coupled to the first chamber and the second chamber via one or more second flow passages having a controllable gas flow between the first chamber and the control device or between the second chamber and the control device;

an input passage configured to provide gas having a first temperature; and a first output passage configured to output gas having a second temperature, the second temperature being lower than the first temperature;

one or more second output passages coupled to the control device and configured to output the gas having a third temperature higher than the first temperature from the control device;

wherein the control device comprises a third chamber and a fourth chamber, and in a first period, a portion of the gas in the fourth chamber expands and flows to the second chamber, a portion of the working fluid in the second chamber flows to the first chamber, and a portion of the gas in the first chamber flows to the third chamber to compress the gas in the third chamber.

16. The air conditioning system of claim 15, wherein in a second period, a portion of the working fluid in the first chamber flows to the second chamber to output a portion of the gas from the second chamber via the first output passage, and a portion of the gas from the control device is outputted via the one or more second output passages.

* * * * *